US005665509A

United States Patent [19]

Brantly

[11] Patent Number: 5,665,509

[45] Date of Patent: Sep. 9, 1997

[54] ELECTROPHOTOGRAPHIC CARRIER COMPOSITIONS HAVING IMPROVED LIFE

[75] Inventor: Thomas Brantly, Nashua, N.H.

[73] Assignee: Nashua Corporation, Nashua, N.H.

[21] Appl. No.: 748,377

[22] Filed: Nov. 13, 1996

[51] Int. Cl.[6] ..... G03G 9/113

[52] U.S. Cl. ..... 430/108; 430/137; 430/106.6

[58] Field of Search ..... 430/108, 137

[56] References Cited

U.S. PATENT DOCUMENTS

| | | | |
|---|---|---|---|
| Re. 32,883 | 3/1989 | Lu | 430/110 |
| 4,286,038 | 8/1981 | Lu et al. | 430/108 |
| 4,298,672 | 11/1981 | Lu | 430/108 |
| 4,433,040 | 2/1984 | Niimura et al. | 430/109 |
| 4,614,700 | 9/1986 | Yamamoto et al. | 430/122 |
| 4,868,082 | 9/1989 | Kohri et al. | 430/106.6 |
| 4,883,736 | 11/1989 | Hoffend et al. | 430/110 |
| 4,935,326 | 6/1990 | Creatura et al. | 430/108 |
| 5,071,725 | 12/1991 | Kubo et al. | 430/108 |
| 5,071,726 | 12/1991 | Maniar | 430/106.6 |
| 5,104,762 | 4/1992 | Shirose et al. | 430/106.6 |
| 5,126,225 | 6/1992 | Wilson et al. | 430/108 |
| 5,192,635 | 3/1993 | Inukai et al. | 430/108 |
| 5,230,980 | 7/1993 | Maniar | 430/137 |
| 5,393,631 | 2/1995 | Horikoshi et al. | 430/108 |
| 5,411,832 | 5/1995 | Yoerger | 430/108 |
| 5,491,044 | 2/1996 | Wilson et al. | 430/110 |

FOREIGN PATENT DOCUMENTS

| | | | |
|---|---|---|---|
| 64-29861 | 1/1989 | Japan | 430/108 |
| 64-29866 | 1/1989 | Japan | 430/108 |

*Primary Examiner*—Roland Martin

*Attorney, Agent, or Firm*—Weingarten, Schurgin, Gagnebin & Hayes LLP

[57] ABSTRACT

Electrophotographic carrier compositions comprising a coating containing a resin and a mixture of positive and negative charge agents, and methods for making such carriers; and electrophotographic developers containing the same are disclosed.

16 Claims, No Drawings

ELECTROPHOTOGRAPHIC CARRIER COMPOSITIONS HAVING IMPROVED LIFE

FIELD OF THE INVENTION

This invention relates to electrophotographic carrier compositions in general, and in particular, to carrier compositions having a coating which provides for longer life and less carrier scum than conventional carriers, and for electrophotographic developers containing these carriers.

BACKGROUND OF THE INVENTION

Electrophotographic processes and apparatus employ the use of toners, which are generally comprised of a resin and a colorant, along with other desirable additives like charge control agents. In general, a desired image is formed on an organic photoconductor (OPC) coated medium such as a drum or belt in the form of a charged pattern representing the image. Toner is then electrically attracted to the charge on the drum and adheres to the drum in an imagewise manner. Lastly, the toner image is transferred from the OPC medium to an image-receiving substrate (typically paper) and fused, resulting in permanent image formation on the substrate.

In magnetic brush development systems, charge is imparted to the toner triboelectrically by mixing toner particles with carrier particles, which are typically resin-coated steel particles about 20 to 200μ in diameter. The toner particles adhere to the oppositely-charged carrier particles and are conveyed from a hopper to the magnetic brush roller system. On the roller chains of the toner-laden carrier particles form, and as the chains are conveyed on the roller into the gap between the roller and the OPC medium, the charged toner particles are attracted to and deposited on the oppositely-charged latent image areas of the OPC medium. The carrier particles are collected and recycled for remixing with toner.

Since the carrier is a recyclable component of the developer, it is naturally of great concern to make it last as long as possible so as to minimize cost. A persistent problem in the art is "toner scum", wherein after a period of mixing with toner, toner particles irreversibly adhere to the carrier, rendering triboelectric charging ineffective and necessitating replacement of the carrier.

A related problem is the selection of coatings for the carrier particles. When designing developer for copying machines, many factors must be considered, one of which is the triboelectric characteristics of the carrier particles vis-a-vis the particular toner required by the copier mechanics. Much development work is devoted to toner chemistry and physics and the goal of having the toner form a good printed image on the paper. However, because the toner cannot form an image on the photoconductor unless the toner is sufficiently triboelectrically charged, then subsequently separated from the carrier particles during imaging (within the mechanical and physical copier design parameters chosen), the chemical and physical design of the carrier must be considered also. Therefore, carrier and toner must be engineered to work together as a developer. When many different developer formulations are under development, for many different machines, this can be a complicated effort. It would therefore be preferable to be able to formulate and characterize one carrier formulation that can be easily and predictably optimized to the particular demands of any given toner and its respective copying system, so as to produce a "tailor-made" developer at a lower cost.

Another issue that arises in toner manufacture is that of unremoved solvent such as methyl ethyl ketone (MEK) in the carrier coating after the carrier has been processed. Trace amounts of solvent in the carrier coating are deleterious to developer performance because toner can adhere to carrier particles having unremoved MEK. Furthermore, the MEK will dissolve the toner, creating a sticky residue on the surface of the carrier that greatly reduces the triboelectric effectiveness of the carrier.

SUMMARY OF THE INVENTION

The present invention relates to carrier compositions having a coating providing longer carrier life and less carrier scum than those used in conventional developer systems, as well as electrophotographic developers containing these carriers. A carrier composition as presently disclosed comprises a core material and a coating comprising a resin, and a mixture of positive and negative charge agents. The triboelectric characteristics of the coating may be adjusted by varying the ratio of positive to negative charge agents in the coating so as to adjust the net charge on the carrier particles to a desired value. In one advantageous embodiment the coating composition comprises a fluoropolymeric resin and a mixture of Nigrosine; and chromate (1-) bis{3-hydroxy-4-[2-hydroxy-(3,5-dinitrophenyl) azo]-N-phenyl-2-naphthalene carboxamato(2-)}-hydrogen ("TRH") or salts thereof.

DETAILED DESCRIPTION OF THE INVENTION

A carrier coating as presently disclosed comprises a resin and a mixture of positive and negative charge agents is disclosed which provides a carrier material having longer life. Additionally, a carrier coating is disclosed having desirable triboelectric characteristics which may be predictably obtained by adjusting the ratio of the positive and negative charge agents in the coating so as to adjust the net charge on the carrier particles to a desired value. The combination of resin and certain charge agents also provides the surprising advantage of allowing for the easier removal of solvents such as MEK used in coating the core particles.

"Resin" as used herein is defined as a triboelectrically-chargeable material that is a solid at room temperature and is therefore suitable for coating carrier particles. Non-limiting examples of suitable resins are fluoropolymers such as chlorotrifluoroethylene vinylidene fluoride, polyvinylidene fluoride, polytrifluoroethylene and polytetrafluoroethylene (PTFEs); polycarbonates; cellulose acetate butyrate; substituted or unsubstituted polyvinyl pyrollidones; glass; polysulfones; acrylonitrile-butadiene-styrene terpolymer (ABS); polyesters; phenolic resins; nylons; alkyl celluloses; polymethylmethacrylate (PMMA); polystyrenes; polyisobutylenes; natural rubbers; polyformaldehyde; polyamides; polyurethanes; styrene-acrylonitrile copolymers; and styrene-butadiene copolymers. Fluoropolymers have been found particularly advantageous.

Carrier particles as used herein comprise a core of, typically, ferromagnetic material, e.g., steel, nickel, iron, ferrites, or mixtures thereof. The average particle size of the core is typically in the range of 20 to 200μ. The core particles are then coated with the coating material as disclosed herein. The carrier particles should possess sufficient density, inertia and magnetic properties to avoid adhering to the latent image on the OPC medium during the development process. Depending on the type of development system under consideration, the shape of the carrier particles may be smooth or irregular.

Positive charge agents that may be used include Nigrosine dyes; triamino triphenylmethanes; cationic dyes; alkyl pyridinium halides such as cetyl pyridinium halide; organic sulfate or sulfonates; distearyl dimethyl ammonium sulfate; bisulfates; and dioxazines.

Negative charge agents that may be used include heliogen green pigment; metal complexes of phthalic acid, naphthoic acid, or salicylic acid; copper-phthalocyanines; perylenes; quinacidones; o-fluorobenzoic acids; p-halo phenyl carboxylic acids; azo pigments; metal-salt azo pigments; azo-chromium complexes; chromate (1-) bis{3-hydroxy-4-[(2-hydroxy-3,5-dinitrophenyl) azo]-N-phenyl-2-naphthalene carboxamato(2-)}-hydrogen ("TRH") or salts thereof.

An important distinction of the carrier compositions disclosed herein is that the charge agents are incorporated in the carrier coating, compared to the usual practice of dispersing such agents in toner or developer. The direct benefits of the invention, e.g., reduction of toner scum, are obtained as a result. The charge agents may be added to the carrier coating in any effective amount so as to obtain the benefits disclosed in this patent application, but not so much as to deteriorate the other requirements of carrier materials, e.g., abrasion resistance and proper charging characteristics. Keeping this in mind, the charge agents may be desirably added in a range from about 0.5 to 10% by weight, based on the total weight of the dry coating.

Other indirect and unexpected benefits, however, are also obtained, such as the simplification of the task of manufacturing carrier for a wide range of copying or development systems. For example, since the triboelectric properties of the carrier may be varied predictably by changing the proportion of positive to negative charge agents in the coating, it is contemplated that one apparatus, comprising storage and metering means for resin, positive, and negative charge agent; and a mixing apparatus is all that is needed for one to produce carrier core coating. One needing to make carrier for a particular system would simply need to do no more than determine the proportions of each of the coating components necessary for the proper triboelectric characteristics, i.e., determine the desired net charge on the carrier particles, enter in the proper settings on the equipment to dispense the proper amounts of each component, mix and prepare the coating, and coat the core particles in the usual manner.

It has also been noted that solvent such as MEK used as a carrier solvent to enable the coating to be sprayed on the core particles surprisingly, can be more easily removed when the coating contains charge agents such as Nigrosine. When conventional coatings are made, i.e., without the presently disclosed charge agents, the drying procedure requires much care to ensure that all of the solvent is removed from the carrier particles at the maximum temperature allowable by the coating. However, the presently described coatings comprising charge agents such as Nigrosine allow the carrier to be dried at a higher allowable temperature, better ensuring that all of the coating solvent is removed and avoiding the undesired result of toner sticking to the carrier when blended as developer.

Toner that may be used with carrier as described herein essentially comprises a thermoplastic binder consisting of a thermoplastic resin or mixture of resins, and colorants such as carbon black, finely dispersed dye pigments, or soluble dyes, and may further include infra-red or ultra-violet absorbing substances and substances that produce black in admixture. Suitable resins include transparent thermoplastic resins such as polyesters, polyethylenes, polystyrenes and copolymers thereof such as styrene-acrylic resin and styrene-butadiene resin; (meth)acrylates; polyvinyl chlorides; vinyl acetates; copoly(vinyl chloride-vinyl acetate);, copoly(vinyl chloride-vinyl acetate-maleic acid); vinyl butyryl resins; polyvinyl alcohols; polyurethanes; polyamides; polyolefins; and styrene polymer. The diameter of dry toner particles for use in magnetic brush development typically ranges from about 8 to 13μ, with an average of about 10μ in general-purpose applications. For high resolution development, the toner particle diameter is typically in the 3 to 8μ range.

"Electrophotographic printing" is defined herein to include both electrographic and electrophotographic printing. (As used herein, the term "electrophotographic" also includes the direct image-wise application of electrostatic charges on an insulating support, for example by ionography.) In electrographic printing, an electrostatic charge is deposited imagewise on a dielectric recording member. In electrophotographic printing, an overall electrostatically charged photoconductive dielectric recording member is image-wise exposed to conductivity increasing radiation producing thereby a "charge area" or "discharge area" toner-developable charge pattern on the recording member.

The following non-limiting example illustrates a specific embodiment of the invention.

EXAMPLE 1

A carrier composition in accordance with the disclosure was made as follows. A coating solution was prepared by first making a dispersion concentrate and then diluting the concentrate for coating. The concentrate was prepared by dissolving 40.0 g Oxy-461 fluoropolymer (Occidental Petroleum) in 150 g methyl ethyl ketone (MEK); combining this solution with 5.0 g Vulcan 9A32 (Cabot Corporation) carbon black, 2.5 g Nigrosine Base B (Orient Chemical) and 2.5 g TRH (Hodogaya Chemical); and milling the mixture in a laboratory attritor for 40 minutes. The attritor was cooled with running water and had ⅛" steel shot for a milling medium. A replicate concentrate was prepared, added to the first concentrate and then the total solids reduced to 8% with MEK.

The solution was then spray coated onto 5000 g of Anchor Steel 100/150 steel shot heated to 120° F. in a laboratory size fluid bed coater. When the coating operation was completed, the coating was further dried for one hour at 125° F.

The carrier was blended with toner and placed in a copier for testing. The developer was used to make one million copies. It had a charge-to-mass ratio of 15.2 μC/g at 4.6% toner concentration throughout the test run. All the copies made were high quality images with solid area densities ranging from 1.36 to 1.49.

EXAMPLE 2

A comparative test was conducted to show the beneficial effects of a carrier composition made accordance with the disclosure versus a control. The test procedure was as follows. The developer (comprising toner and carrier) was added to a photocopier machine to make copies. At certain intervals the developer was sampled to conduct surface fluorine measurements on the carrier by ESCA. Q/m and TC (toner concentration) were measured by the blowoff method. The stability of the surface fluorine, Q/m and TC values over time is a measurement of how well the developer stabilizes and "breaks in" in the machine; these values should stabilize after an initial refractory period, allowing for acceptable experimental variations. Both carriers were made generally according to the procedure in Example I, with a coat weight of 2% (i.e., weight of the coating based on the total weight of carrier plus coating). The carrier compositions were I (control): Oxy-461 fluoropolymer/carbon black/Nigrosine Base B (85/10/5), and II (invention): Oxy-461 fluoropolymer/carbon black/Nigrosine Base B/TRH (80/10/5/5).

The data are shown in Tables 1 and 2. It can be seen that developer in accordance with the disclosure remains desirably stable over several hundred copies, in comparison to the other developer tested.

TABLE 1

| Copies (× 1000) | F (%) | Q/m (uC/g) | TC (%) |
|---|---|---|---|
| 0 | 31.7 | 17.4 | 2.9 |
| 40 | 12.6 | 11.1 | 1.8 |
| 50 | 14.3 | 11.8 | 1.8 |
| 105 | 11.3 | 10.9 | 1.6 |
| 125 | 10.2 | 11.8 | 1.5 |
| 155 | 11.5 | 11.8 | 1.4 |
| 459 | — | 14.3 | 1.2 |

TABLE 2

| Copies (× 1000) | F (%) | Q/m (uC/g) | TC (%) |
|---|---|---|---|
| 0 | 34.2 | 10.5 | 3.6 |
| 30 | 15.6 | 11.3 | 2.3 |
| 50 | 17.3 | 13.8 | 4.0 |
| 100 | 16.5 | 15.6 | 4.2 |
| 150 | 15.9 | 15.8 | 4.4 |
| 200 | 16.0 | 14.6 | 4.8 |
| 500 | 16.6 | 15.6 | 4.4 |
| 750 | 15.9 | 16.7 | 3.9 |
| 950 | 18.4 | 13.7 | 4.8 |

The foregoing description is meant to be illustrative of novel carrier compositions, electrophotographic developers containing the same, and methods of making improved carriers and developers. Other embodiments and variations will be apparent to those of ordinary skill in the art without departing from the inventive concepts contained herein. Accordingly, this invention is to be viewed as embracing each and every novel feature and novel combination of features present in or possessed by the invention disclosed herein and is to be viewed as limited solely by the scope and spirit of the appended claims.

What is claimed is:

1. An electrophotographic carrier composition, comprising carrier particles comprising a core and a coating thereupon, said coating comprising a resin and a mixture of positive and negative charge agents.

2. The carrier composition of claim 1 wherein said positive charge agent is selected from the group consisting of Nigrosine dyes; triamino triphenylmethanes; cationic dyes; alkyl pyridinium halides; organic sulfates or sulfonates; distearyl dimethyl ammonium sulfate; bisulfates; dioxazines; and mixtures thereof.

3. The carrier composition of claim 1 wherein said negative charge agent is selected from the group consisting of heliogen green pigment; metal complexes of phthalic acid, naphthoic acid, or salicylic acid; copper-phthalocyanines; perylenes; quinacidones; o-fluorobenzoic acids; p-halo phenyl carboxylic acids; azo pigments; metal-salt azo pigments; azochromium complexes; chromate (1-) bis{3-hydroxy-4-[(2-hydroxy-3,5-dinitrophenyl) azo]-N-phenyl-2-naphthalene carboxamato(2-)]-hydrogen or salts thereof; and mixtures thereof.

4. The carrier composition of claim 1 wherein said resin is selected from the group consisting of chlorotrifluoroethylene vinylidene fluoride; polyvinylidene fluoride; polytrifluoroethylene; polytetrafluoroethylene; polycarbonates; cellulose acetate butyrate; substituted or unsubstituted polyvinyl pyrollidones; glass; polysulfones; acrylonitrile-butadiene-styrene terpolymer; polyesters; phenolic resins; nylons; alkyl celluloses; polymethylmethacrylate (PMMA); polystyrenes; polyisobutylenes; natural rubbers; polyformaldehyde; polyamides; polyurethanes; styrene-acrylonitrile copolymers; styrene-butadiene copolymers; and mixtures thereof.

5. The carrier composition of claim 1 wherein said resin is a fluoropolymeric resin; said positive charge agent is a Nigrosine dye; and said negative charge agent is chromate (1-) bis{3-hydroxy-4-[2-hydroxy-(3,5-dinitrophenyl) azo]-N-phenyl-2-naphthalene carboxamato(2-)]-hydrogen ("TRH") or a salt thereof.

6. The carrier composition of claim 1 wherein the average particle size of said core is in the range of 20 to 200μ.

7. The carrier composition of claim 1 wherein said mixture of positive and negative charge agents is present in said coating in an amount of from about 0.5 to 10% by weight, based on the total weight of the dry coating.

8. An electrophotographic developer composition, comprising carrier particles comprising a core and a coating thereupon, said coating comprising a resin and a mixture of positive and negative charge agents; and toner particles.

9. The developer composition of claim 8 wherein said positive charge agent is selected from the group consisting of Nigrosine dyes; triamino triphenylmethanes; cationic dyes; alkyl pyridinium halides; organic sulfates or sulfonates; distearyl dimethyl ammonium sulfate; bisulfates; dioxazines; and mixtures thereof.

10. The developer composition of claim 8 wherein said negative charge agent is selected from the group consisting of heliogen green pigment; metal complexes of phthalic acid, naphthoic acid, or salicylic acid; copper-phthalocyanines; perylenes; quinacidones; o-fluorobenzoic acids; p-halo phenyl carboxylic acids; azo pigments; metal-salt azo pigments; azochromium complexes; chromate (1-) bis{3-hydroxy-4-[(2-hydroxy-3,5-dinitrophenyl) azo]-N-phenyl-2-naphthalene carboxamato(2-)]-hydrogen or salts thereof; and mixtures thereof.

11. The developer composition of claim 8 wherein said resin is selected from the group consisting of chlorotrifluoroethylene vinylidene fluoride; polyvinylidene fluoride; polytrifluoroethylene; polytetrafluoroethylene; polycarbonates; cellulose acetate butyrate; substituted or unsubstituted polyvinyl pyrollidones; glass; polysulfones; acrylonitrile-butadiene-styrene terpolymer; polyesters; phenolic resins; nylons; alkyl celluloses; polymethylmethacrylate (PMMA); polystyrenes; polyisobutylenes; natural rubbers; polyformaldehyde; polyamides; polyurethanes; styrene-acrylonitrile copolymers; styrene-butadiene copolymers; and mixtures thereof.

12. The developer composition of claim 8 wherein said resin is a fluoropolymeric resin; said positive charge agent is a Nigrosine dye; and said negative charge agent is chromate (1-) bis{3-hydroxy-4-[2-hydroxy-(3,5-dinitrophenyl) azo]-N-phenyl-2-naphthalene carboxamato(2-)]-hydrogen ("TRH") or a salt thereof.

13. The developer composition of claim 8 wherein the average particle size of said core is in the range of 20 to 200μ.

14. The developer composition of claim 8 wherein said mixture of positive and negative charge agents is present in said coating in an amount of from about 0.5 to 10% by weight, based on the total weight of the dry coating.

15. The developer composition of claim 8 wherein said toner particles have a diameter from about 8 to 13μ.

16. A method of adjusting the triboelectric characteristics of a carrier composition containing a core and a resin-containing coating, comprising the step of preparing a coating material for application to metal core particles comprising resin and positive and negative charge agents, wherein said ratio of said positive and negative charge agents is effective to impart a desired net charge to said carrier particles, and the step of applying said coating material to a metal core.

* * * * *